US006390848B1

(12) United States Patent
Murakami et al.

(10) Patent No.: US 6,390,848 B1
(45) Date of Patent: May 21, 2002

(54) ENGAGEMENT STRUCTURE OF WATERPROOF CONNECTOR AND DUMMY PLUG

(75) Inventors: Takao Murakami; Masaru Fukuda, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/421,364

(22) Filed: Oct. 19, 1999

(30) Foreign Application Priority Data

Oct. 20, 1998 (JP) ..... 10-298748

(51) Int. Cl.[7] ..... H01R 13/44; H01R 13/28; H01R 13/40

(52) U.S. Cl. ..... 439/587; 439/279; 439/148

(58) Field of Search ..... 439/587, 586, 439/275, 271, 277, 274, 148, 279

(56) References Cited

U.S. PATENT DOCUMENTS 4,993,964 A * 2/1991 Trummer ..... 439/272
5,618,198 A * 4/1997 Sato et al. ..... 439/274
5,720,487 A * 2/1998 Kato ..... 277/637
5,931,699 A * 8/1999 Saito ..... 439/587
5,997,351 A * 12/1999 Okabe ..... 439/274
6,036,541 A * 3/2000 Koumatsu ..... 439/587
6,039,603 A * 3/2000 Wakata et al. ..... 439/587
6,247,965 B1 * 6/2001 Cummings et al. ..... 439/148

FOREIGN PATENT DOCUMENTS

| | | |
|---|---|---|
| JP | 62-4078 | 1/1987 |
| JP | 63-50468 | 4/1988 |
| JP | 2-3674 | 1/1990 |
| JP | 7-122331 | 5/1995 |

* cited by examiner

*Primary Examiner*—P. Austin Bradley
*Assistant Examiner*—Edwin A. León
(74) *Attorney, Agent, or Firm*—Finnegan, Henderson, Farabow, Garrett & Dunner, L.L.P.

(57) ABSTRACT

An engagement structure of a waterproof connector and a dummy plug includes: a connector housing having a plurality of terminal accommodation chambers, a plurality of rubber plug accommodation recesses formed therein and one wall portion having wire insertion and passing-through holes through; rubber plugs respectively inserted forcibly into the plurality of rubber plug accommodation recesses which are respectively formed with wire insertion and passing-through holes through which the wire is respectively inserted to pass; and a dummy plug sealing one of the wire insertion and passing-through holes of the plurality of rubber plugs. The dummy plug has a shaft portion which is inserted into the wire insertion and passing-through hole of the rubber plug to seal the wire insertion and passing-through hole of the rubber plug. The dummy plug further has a flange portion and engaging protrusions.

9 Claims, 5 Drawing Sheets

ENGAGEMENT STRUCTURE OF WATERPROOF CONNECTOR AND DUMMY PLUG

BACKGROUND OF THE INVENTION

1. Field of the Invention

The present invention relates to an engagement structure of a multi-polar waterproof connector and a dummy plug, where a waterproof performance between a connector housing and a plurality of wires to which terminals are respectively connected is improved and a waterproof performance of a portion of the connector housing to which a wire is not connected is improved using a dummy plug.

2. Description of the Related Art

As a dummy plug for a waterproof connector of this type, there are one shown in FIGS. 1 and 2 and disclosed-in Japanese Utility Model Application Laid-Open No. 63-50468 and one shown in FIGS. 3 and 4 and disclosed in Japanese Patent Application Laid-Open No. 7-122331.

A dummy plug A for a waterproof connector illustrated in FIGS. 1 and 2 is constituted with a core member 5 made of synthetic resin and having a shaft portion 5*a* and a head 5*b* formed in a disc stepped shape, and an almost cylindrical rubber plug 6 fitted on the shaft portion 5*a* of the core member 5. As illustrated in FIGS. 1 and 2, a plurality of retaining protrusions 5*c* are formed on the shaft portion 5*a* of the core member 5, and the respective retaining protrusions 5*c* are engaged with or retained in a recessed portion 6*a* formed inside the rubber plug 6.

Then, the dummy plug A is fitted in an empty terminal accommodation hole (not shown) in a connector housing of a waterproof connector (not shown), so that water is prevented from permeating the empty terminal accommodation hole. At this time, a plurality of guide portions 5*d* provided on the head 5*b* of the core member 5 abut on an inner face of the terminal accommodation hole of the connector housing so that the dummy plug A is positioned and fitted in the terminal accommodation hole. Also, when a terminal connected with a wire is accommodated in a terminal accommodation hole of the connector housing, the terminal is retained by a lance (a flexible retaining arm) not shown.

A dummy plug B for a waterproof connector illustrated in FIGS. 3 and 4 is constituted with a rubber plug 7 for sealing a wire which is fitted in an empty terminal accommodation hole 2 of a plurality of terminal accommodation holes 2 formed in a connector housing 1 of the waterproof connector in which a male terminal is not inserted and a rear holder 8 made of synthetic resin and having a shaft portion 8*a* having the same diameter as that of a wire 3 inserted into a wire passing-through hole 7*a* of the rubber plug 7.

As shown in FIG. 4, a frame-like and overhanging-shaped flexible locking portion 8*b* of the rear holder 8 and an engaging pawl 1*a* of the connector housing 1 are engaged with each other, so that the dummy plug B is fitted into the empty terminal accommodation hole 2 of the connector housing 1 which is not used and is retained therein, thereby preventing water from permeating the empty terminal accommodation hole 2 from the outside thereof.

However, the dummy plug A used for the connector housing of the conventional waterproof connector has an engagement structure where the rubber plug 6 is prevented from coming off by retaining the respective retaining protrusions 5*c* provided in a projecting manner on the shaft 5*a* of the core member 5 in the recessed portion 6*a* of the rubber plug 6 and the rubber plug 6 is fitted into a base end portion of the empty terminal accommodation hole of the connector housing which is not used. Therefore, a retaining or engaging force of the dummy plug A to the empty terminal accommodation hole of the connector housing is weak or poor so that the dummy plug A is apt to easily come off from the terminal accommodation hole of the connector housing.

Also, the dummy plug B used for the connector housing 1 of the conventional waterproof connector has a complicated structure where the flexible locking portion 8*b* provided in a projecting manner on the rear holder 8 is caused to be engaged with the engaging pawl 1*a* of the connector housing 1 to prevent the dummy plug B from coming off. Therefore, the entire dummy plug B is large-sized and manufacturing cost thereof is increased.

SUMMARY OF THE INVENTION

The present invention has been attained in order to solve the above problems and an object thereof is to provide an engagement structure of a multi-polar waterproof connector and a dummy plug, where an engaging force (retaining force) of a dummy plug to a connector housing is enhanced and the dummy plug can be reduced in size and its manufacturing cost can be reduced.

A first aspect of the present invention is an engagement structure of a waterproof connector and a dummy plug comprising: a connector housing having a plurality of terminal accommodation chambers formed therein, the terminal accommodation chambers being chambers into which a terminal connected with a wire is to be inserted, the connector housing further having a plurality of rubber plug accommodation recesses formed therein, the rubber plug accommodation recesses being formed at positions opposed to the terminal accommodation chambers, the connector housing having one wall portion at an end opposed to the terminal accommodation chambers, and the one wall portion having wire insertion and passing-through holes through which the wire is respectively inserted to pass; rubber plugs respectively inserted forcibly into the plurality of rubber plug accommodation recesses, the rubber plugs being respectively formed with wire insertion and passing-through holes through which the wire is respectively inserted to pass; and a dummy plug sealing one of the wire insertion and passing-through holes of the plurality of rubber plugs, the dummy plug having a shaft portion which is inserted into the wire insertion and passing-through hole of the rubber plug to seal the wire insertion and passing-through hole of the rubber plug, the dummy plug further having at its one end a flange portion, and the shaft portion having engaging protrusions; wherein, when the wire is inserted to pass through the wire insertion and passing-through hole of one rubber plug of the plurality of rubber plugs and one of the wire insertion and passing-through holes formed in the one wall portion, the rubber plug seals the terminal accommodation chamber and the wire; wherein, when the wire is not inserted to pass through the wire insertion and passing-through hole of the other rubber plug of the plurality of rubber plugs and the other wire insertion and passing-through hole formed in the other wall portion, the dummy plug is inserted to pass through the wire insertion and passing-through hole of the other rubber plug and the other wire insertion and passing-through hole formed in the other wall portion, whereby the wire insertion and passing-through hole of the other rubber plug is sealed by the shaft portion of the dummy plug; and wherein a portion of the other wall portion around the other wire insertion and passing-through hole of the other wall portion is sandwiched between the flange portion of the dummy plug and the engaging protrusion of the dummy plug.

In the engagement structure of a waterproof connector and a dummy plug of the first aspect, when the shaft portion of the dummy plug is inserted from the wire insertion and passing-through hole of the one wall portion of the connector housing into the wire insertion and passing-through hole of the rubber plug into which a wire is not inserted, a portion of the wire insertion and passing-through hole of the one wall portion is retained so as to be sandwiched between the engaging protrusions of the shaft portion and the flange portion thereof, so that a retaining or engaging force of the dummy plug to the connector housing is improved.

A second aspect of the invention is an engagement structure of a waterproof connector and a dummy plug according to the first aspect, wherein the engaging protrusion of the dummy plug is accompanied with other engaging protrusions, the plurality of engaging protrusions are formed on a peripheral face of the shaft portion of the dummy plug in a projecting manner, and the plurality of engaging protrusions are positioned at equal intervals; wherein the plurality of engaging protrusions are formed integrally with the shaft portion; wherein the diameter of the flange portion of the dummy plug is larger than that of the other wire insertion and passing-through hole of the other wall portion; wherein the flange portion is formed integrally with the shaft portion; and wherein a gap between each of the engaging protrusions and the flange portion is approximately equal to the thickness of the one wall portion.

In the engagement structure of a waterproof connector and a dummy plug of the second aspect, such a simple structure can be obtained where the plurality of engaging protrusions and the flange portion are formed on the shaft portion of the dummy plug with a distance spaced from each other so as to be approximately equal to the thickness of the one wall portion of the connector housing, which results in size-reduction of the entire dummy plug and reduction in manufacturing cost of the same.

A third aspect of the invention is an engagement structure of a waterproof connector and a dummy plug according to the second aspect, wherein each of the engaging protrusions of a width direction is formed in a general triangular shape, and is constituted with an engaging face positioned at the flange portion side and an inclining face positioned at a side of a distal end of the shaft portion; wherein the inclining face positioned at the distal end side of the shaft portion is formed at a slant inclination angle; and wherein the engaging face of the flange portion side is formed at a predetermined engaging angle.

In the engagement structure of a waterproof connector and a dummy plug of the third aspect, the respective engaging protrusions of the shaft portion of the dummy plug are smoothly engaged with, or retained in, the wire insertion and passing-through hole of the one wall portion of the connector housing through moderately inclining faces of the respective generally triangular engaging protrusions, in side view, of the shaft portion of the dummy plug positioned at a distal end side of the shaft portion, and the engaged or retained state thus obtained is securely maintained with the engaging or retaining faces of the respective engaging protrusions positioned at the flange portion side. Thereby, the wire insertion and passing-through hole of the rubber plug into which the wire is not inserted for pass-through is closed and sealed by the shaft portion of the dummy plug, so that water can be prevented from entering from the outside and a waterproof performance of the rubber plug can reliably be secured.

BRIEF DESCRIPTION OF THE ACCOMPANYING DRAWINGS

The above and further objects and novel features of the present invention will more fully appear from the following detailed description when the same is read in conjunction with the accompanying drawings, in which.

DESCRIPTION OF THE PREFERRED EMBODIMENTS

An embodiment of the present invention will be explained with reference to the drawings below.

Figure 1:
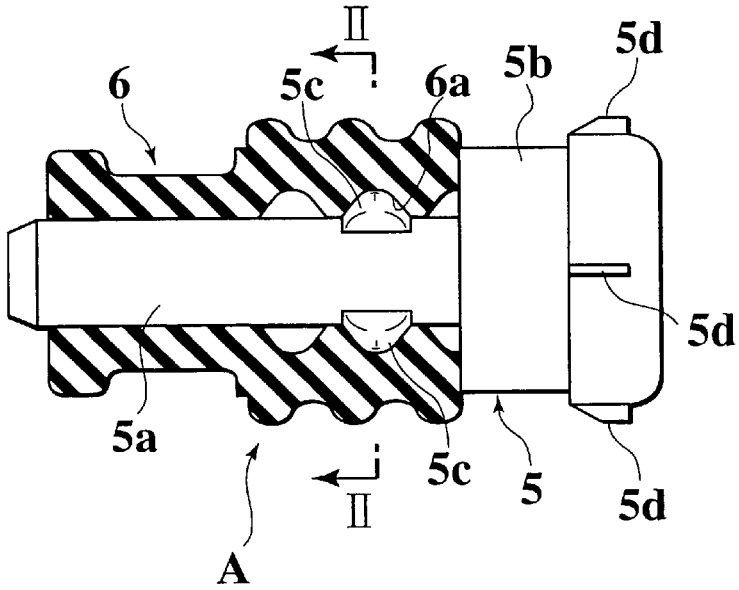
FIG.1 PRIOR ART
FIG. 1 is a sectional view of a conventional dummy plug for a waterproof connector.
Figure 2:
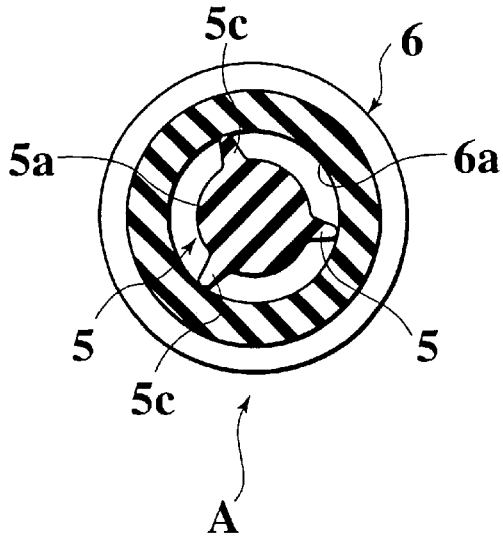
FIG.2 PRIOR ART
FIG. 2 is a sectional view taken along line Y—Y in FIG. 4.
Figure 3:
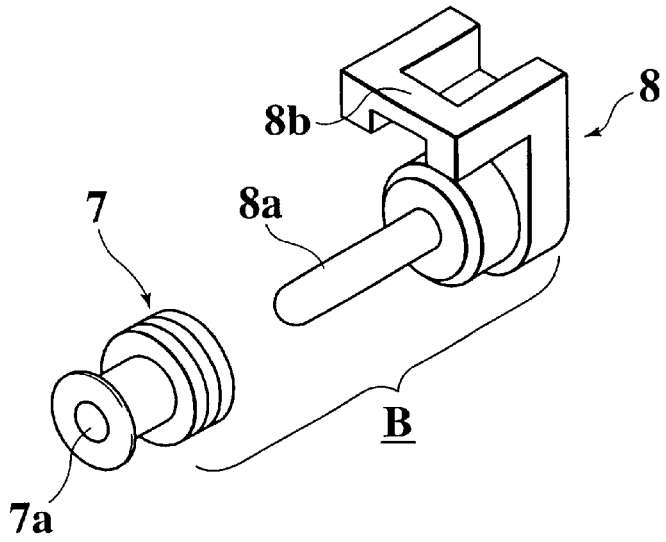
FIG.3 PRIOR ART
FIG. 3 is an exploded perspective view of another conventional dummy plug for a waterproof connector.
Figure 4:
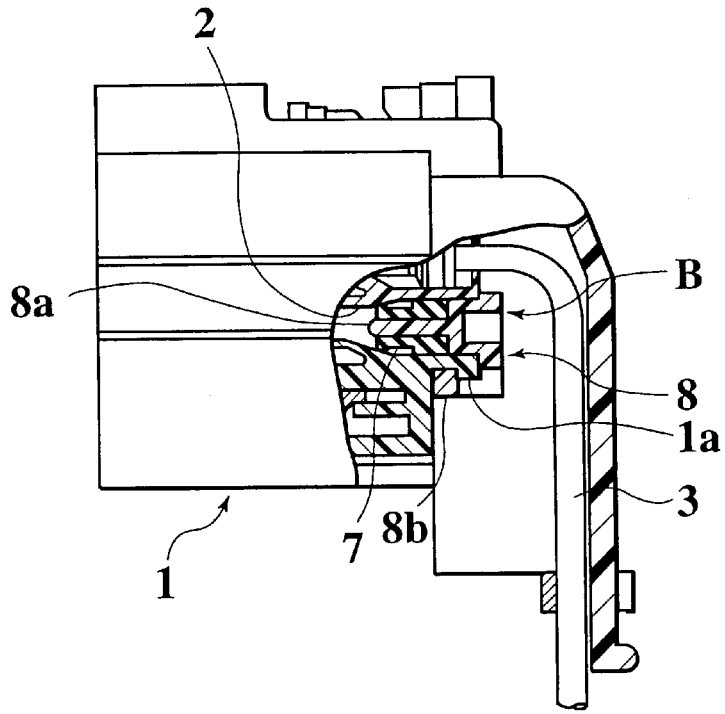
FIG.4 PRIOR ART
FIG. 4 is a side view partially illustrating the another conventional waterproof connector to which the dummy plug is used.
Figure 5:
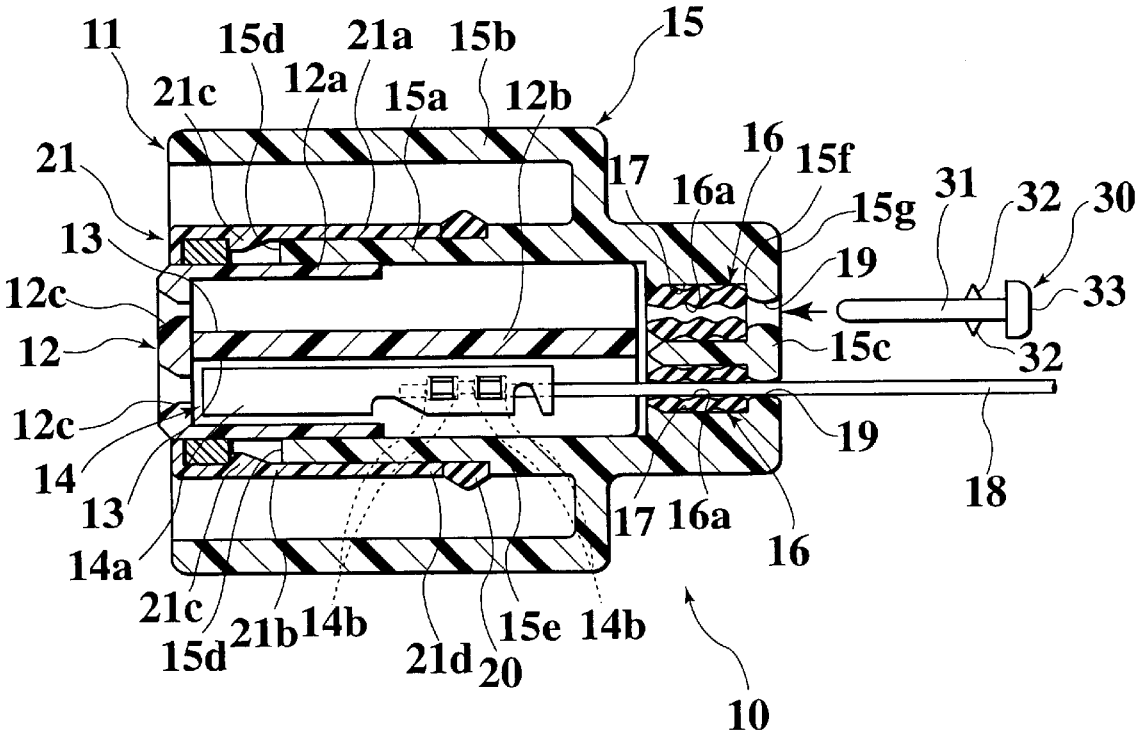
FIG. 5 is a sectional view illustrating a state before engagement of a waterproof connector and a dummy plug according to an embodiment of the present invention.
Figure 6:
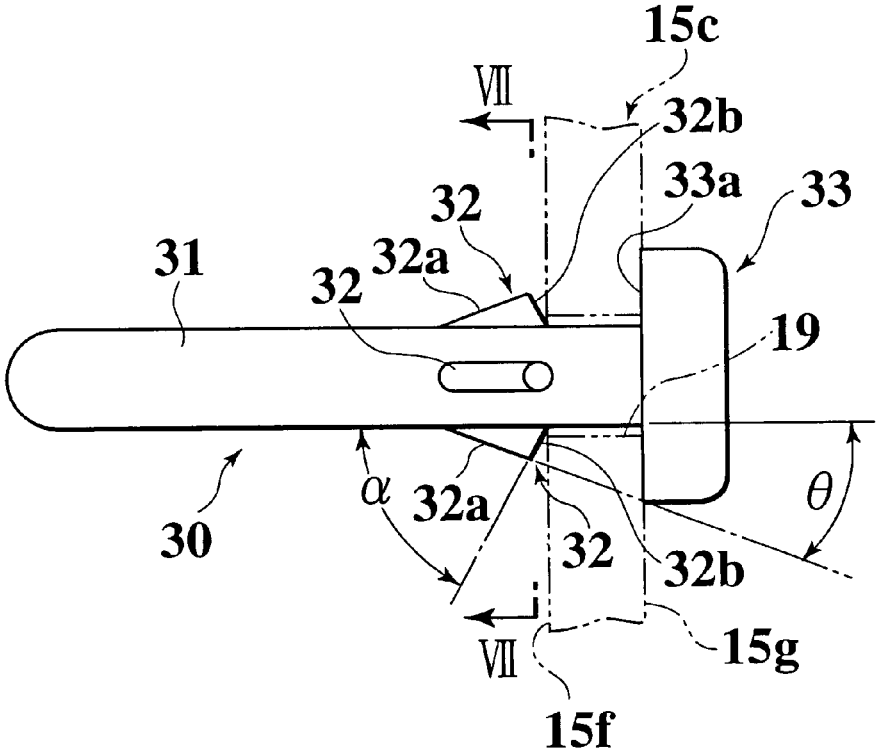
FIG. 6 is a side view of the dummy plug.
Figure 7:
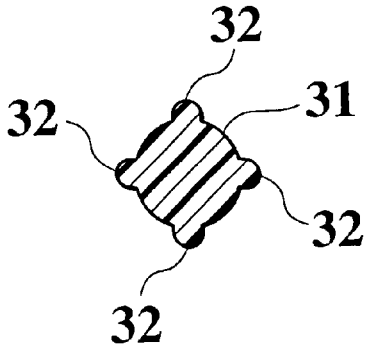
FIG. 7 is a sectional view taken along line VII—VII in FIG. 6.
Figure 8:
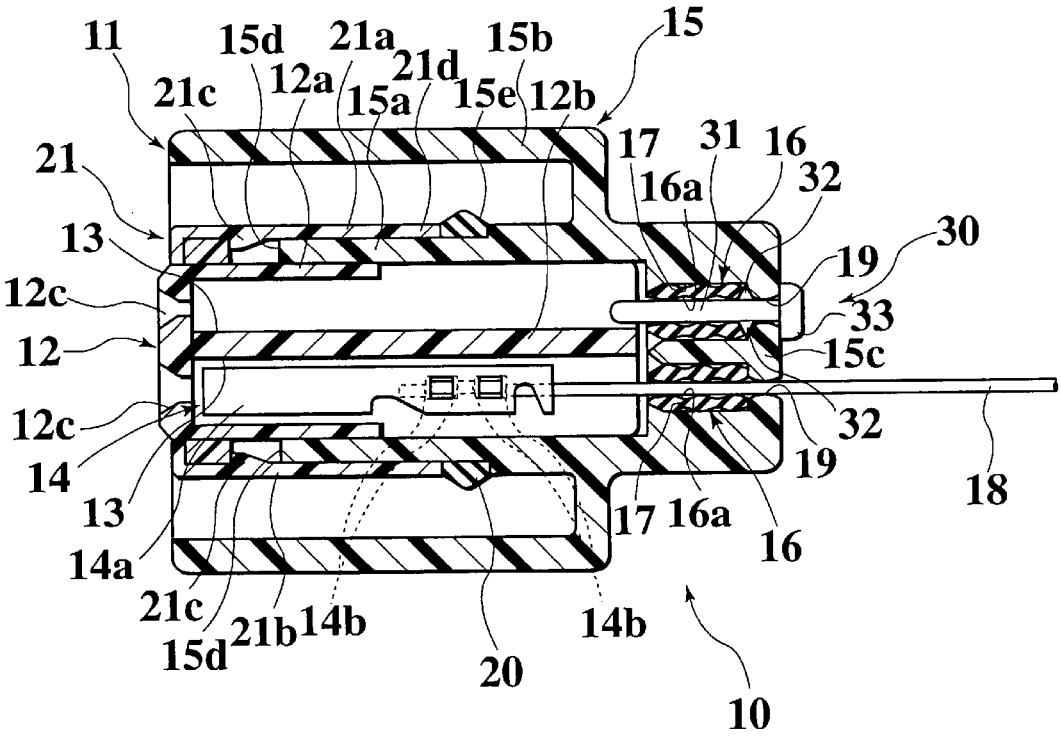
FIG. 8 is a sectional view illustrating a state after engagement of the waterproof connector and the dummy plug.

FIG. 5 is a sectional view illustrating a state before engagement of a waterproof connector and a dummy plug according to an embodiment of the invention, FIG. 6 is a side view of the dummy plug, FIG. 7 is a sectional view taken long line VII—VII in FIG. 6, and FIG. 8 is a sectional view illustrating a state after engagement of the waterproof connector and the dummy plug.

As illustrated in FIGS. 5 and 8, a connector housing 11 of a waterproof connector 10 is constituted with an inner housing 12 made of synthetic resin and having a plurality of terminal accommodation chambers 13 formed integrally therein, an outer housing 15 made of synthetic resin and fitted therein with the inner housing 12, and a spacer 21 made of synthetic resin and fitted in the outer housing 15 and retaining a waterproof packing 20 at its distal end.

The inner housing 12 includes a box portion 12*a* opened at portions of upper and lower faces positioned at a rear side thereof, and the respective terminal accommodation chambers 13 are formed within a space defined with a central horizontal wall 12*b* and respective upper and lower vertical side walls (not shown) also serving as partition walls. Female terminals (terminals) 14 are respectively accommodated in the terminal accommodation chambers 13. It is to be noted that male rectangular passing-through holes 12*c* through which male terminals of a mating connector (not shown) respectively pass are respectively formed at portions of a front wall of the box portion 12*a* of the inner housing 12 opposed to the respective terminal accommodation chambers 13. Furthermore, a pair of press-fitting blades 14*b*, 14*b* are formed in a bending manner on each of both side plates positioned at a rear portion of a box portion 14*a* of the female terminal 14.

The outer housing 15 is formed in a dual wall box shape constituted with an inner wall portion 15*a* of an approximately rectangular shape, an outer wall portion 15*b* of an approximately rectangular shape surrounding the inner wall portion 15*a*, and a bottom wall portion (one wall portion) 15*c* connecting the inner and outer wall portions 15*a* and 15*b* at their rear portions and it is opened at a front face side. The bottom wall portion 15*c* has a thick portion at its central portion, and rubber plug accommodation recessed portions 17, each having a large diameter and a circular sectional configuration, in which waterproof rubber plugs 16 are inserted by press-fitting or the like and accommodated are respectively formed at front side portions of the thick portion opposed to the respective terminal accommodation chambers 13 and wire passing-through holes 19, each having a small diameter and a circular sectional configuration, through which wires 18 respectively pass are respectively formed at rear side portions of the thick portion so as to communicate with corresponding rubber plug accommodation recessed portions 17. It should be noted that each rubber plug 16 is formed in a generally cylindrical shape having corrugated outer and inner peripheral faces and includes therein a wire passing-through hole 16*a* through which the wire 18 passes without any gap.

Also, rectangular engaging or retaining holes (engaging portions) 15*d* with/from which respective engaging pawls (not shown) formed on upper and lower faces of the box portion 12*a* of the inner housing are engaged/disengaged are respectively formed on front side central portions of the upper and lower walls of the inner wall portion 15*a* of the outer housing 15. Furthermore, a V-shaped packing receiving portion 15*e* for receiving an annular packing 20 made of rubber is integrally formed in a projecting manner at an outer face inner side of the inner wall portion 15*a* of the outer housing 15.

The spacer 21 has a generally rectangular structure opened at a front side portion fitted on an outer face of the inner wall portion 15*a* of the outer housing 15 and at a rear side portion. Also, engaging or retaining pawls (engaging portions) 21*c* which are engaged with/disengaged from the respective engaging holes 15*d* of the outer housing 15 are respectively formed on upper and lower walls 21*a* and 21*b* of the spacer 21. Furthermore, a distal end portion 21*d* of the spacer 21 is structured so as to retain the waterproof packing 20 engaged with or retained in the packing receiving portion 15*e* of the inner wall portion 15*a* of the outer housing 15 when the spacer 21 is fitted on the outer housing 15.

As illustrated in FIGS. 5 and 8, the respective wires 18 which pass through the respective wire passing-through holes 19 of the outer housing 15 and the respective wire passing-through holes 16*a* of the respective rubber plugs 16 are respectively connected with pressure between the pairs of press-fitting blades 14*b*, 14*b* of the respective female terminals 14 accommodated in the respective terminal accommodation chambers 13 of the inner housing 12, and the respective terminal accommodation chambers 13 and the respective wires 18 are respectively sealed by the respective rubber plugs 16 and the packing 20.

Also, a shaft portion 31 of a dummy 30 is inserted into each wire passing-through hole 19 of the outer housing 15 through which the wire 18 is not inserted to pass and into the wire passing-through hole 16*a* of each rubber plug 16 accommodated in the rubber plug accommodation recessed portion 17 of the outer housing 15, so that these passing-through holes are sealed. The dummy plug 30 is a rigid body made of hard resin or the like and formed in a T-shape in side view. The shaft diameter of a shaft portion 31 of the dummy plug 30 is approximately equal to the outer diameter of the wire 18 applied. Also, four engaging or retaining protrusions are formed integrally on an outer peripheral face of the shaft portion 31 of the dummy plug 30 at equal intervals along the peripheral direction thereof, and a disk-shaped flange portion 33 having a diameter larger than the hole diameter of each wire passing-through hole 19 of the bottom wall portion 15*c* of the outer housing 15 is formed integrally at a rear end of the shaft portion 31 in a projecting manner.

As shown in FIG. 6, each engaging protrusion 32 formed integrally in a projecting manner on the shaft portion 31 of the dummy plug 30 is formed in a generally triangular shape in side view, and an inclination face 32*a* of the engaging protrusion 32 positioned at a distal end side of the shaft portion 32 is formed at a moderate inclination angle (reference sign θ shown in FIG. 6) such that a force required for inserting the shaft portion 31 into the wire passing-through hole 19 is not increased. Also, an engaging face 32*b* of each engaging protrusion 32 positioned at a side of the flange portion 33 is formed at an engaging angle (reference sign a shown in FIG. 6, wherein α is set to less than 90°) at which the engaging protrusion 32 can be prevented from being injured or the like when it is inserted into/released from the wire passing-through hole 19. Furthermore, a gap or distance between each engaging protrusion 32 and the flange portion 33 is formed so as to be approximately equal to the thickness of the bottom wall portion 15*c* of the outer housing 15. Therefore, when the shaft portion 31 of the dummy plug 30 is inserted into each wire passing-through hole 19 of the bottom wall portion 15*c* of the outer housing 15 and the wire passing-through hole 16*a* of each rubber plug 16 through which the wire 18 is not inserted, inner and outer faces (engaging faces) 15*f* and 15*g* of the bottom wall portion 15*c* about each wire passing-through hole 19 is sandwiched between the engaging face 32*b* of each engaging protrusion 32 of the dummy plug 30 and a back face 33*a* of the flange portion 33 so that it is retained therebetween.

In assembling the waterproof connector 10 of the embodiment, the rubber plugs 16 are inserted into and set to the respective rubber plug accommodation recessed portions 17 inside the bottom wall portion 15*c* of the outer housing 15 constituting an outer side portion of the connector housing 11 form a connector housing fitting direction, and the packing 20 is inserted and set in the packing receiving portion 15*e* of the inner wall portion 15*a* of the outer housing 15. Thereafter, the spacer 21 is fitted on the inner wall portion 15*a* of the outer housing 15, and the respective engaging pawls 21*c* of the spacer 21 are engaged in the respective engaging holes 15*d* of the inner wall 15*a* of the outer housing 15. By engagement of the respective engaging holes 15*d* of the inner wall portion 15*a* of the outer housing 15 and the respective engaging pawls 21*c* of the spacer 21, the packing 20 is prevented from coming off at the distal end of the spacer 21, so that a waterproof performance of the entire connector housing is further improved.

Next, the wires 18 are respectively inserted into the respective wire passing-through holes 16*a* of the respective rubber plugs 16 from the outside through the respective wire passing-through holes 19 of the bottom wall portion 15*c* of the outer housing 15, and they are connected with pressure to the respective pairs of press-fitting blades 14*b*, 14*b* of the female terminals 14 accommodated in the respective terminal accommodation chambers 13 of the inner housing 12 constituting the interior of the connector housing 11. Next, respective engaging pawls (not shown) of the box portion 12*a* of the inner housing 12 are engaged with the respective engaging holes 15*d* of the inner wall portion 15*a* of the outer housing 15, and thus the assembling of the waterproof connector 10 is completed.

At this time, for allowing varieties of applications of the waterproof connector 10 or variation of wire harness circuit and for allowing common use of the varieties of applications of the waterproof connector 10 and the variation of wire harness circuit, there occurs a portion(s) where the wire 18 is not required (where the wire 18 is not required to be inserted) in some cases. In the cases, there is a problem in that, since the rubber plugs 16 are preliminarily inserted into the respective rubber plug accommodation recessed portions 18 of the outer housing 15, water may permeate the terminal accommodation chamber 13 from the wire passing-through hole 16*a* of the rubber plug 16 in which the wire 18 is not inserted, namely the empty rubber plug 16. In this case, the shaft portion 31 of the dummy plug 30 is inserted to pass through the wire passing-through hole 16*a* of the rubber plug 16 inserted forcibly in the rubber plug accommodation recessed portion 17 of the outer housing 15 where the wire 18 is not required from the wire passing-through hole 19 of the bottom wall portion 15*c* of the outer housing 15. When insertion of the shaft portion 31 of the dummy plug 30 is completed, as illustrated in FIG. 8, the inner and outer faces 15*f* and 15*g* of the bottom wall portion 15*c* about the wire passing-through hole 19 are retained between the engaging faces 32*b* of the respective engaging protrusions 32 of the dummy plug 30 and the back face 33*a* of the flange portion 33 thereof in a sandwiching manner. Thereby, the wire passing-through hole 16*a* of the rubber plug 16 is completely closed, water is prevented from permeating the empty terminal accommodation chamber 13 from the outside through the rubber plug 16, and a waterproof performance of the rubber plug 16 in which the wire 18 is not required to be inserted can reliably be secured.

In this manner, when the shaft portion 31 of the dummy plug 30 is inserted to pass through the wire passing-through hole 16*a* of the rubber plug 16 where the wire 18 is not required to pass from the wire passing-through hole 19 of the bottom wall portion 15*c* of the outer housing 15, a portion of the bottom wall portion 15*c* about the wire passing-through hole 19 can be retained between the respective engaging protrusions 32 of the shaft portion 31 of the dummy plug 30 and the flange portion 33 thereof in a sandwiching manner, which results in inter-rigid body engagement of the connector housing 11 and the dummy plug 30, so that an engaging force (retaining force) of the dummy plug 30 to the connector housing 11 can further be improved. Also, the embodiment of the invention has a simple structure where the plurality of engaging protrusions 32 and the flange portion 33 are formed integrally on the shaft portion 31 of the dummy plug 30 with a distance or gap therebetween approximately equal to the thickness of the bottom wall portion 15*c* of the outer housing 15, which allows size reduction of the dummy plug 30 and manufacturing cost reduction thereof.

Furthermore, through the moderate inclination faces 32*a* of the respective engaging protrusions 32 of a generally triangular shape, in side view, formed on the shaft portion 31 of the dummy plug 30 at the distal end side thereof, the respective engaging protrusions 32 of the shaft portion 31 can be smoothly engaged with the wire passing-through holes 19 of the bottom wall portion 15*c* of the outer housing 15, and the engaged state thus obtained can securely be retained at the engaging faces 32*b* of the respective engaging protrusions 32 positioned at the flange portion 33 side. Accordingly, the wire passing-through hole 16*a* of the rubber plug 16 in which the wire 18 is not inserted can completely be closed and sealed by the shaft portion 31 of he dummy plug 30, and water can securely be prevented from permeating the rubber plug 16 from the outside, thereby securing the waterproof performance of the rubber plug 16. Also, as the engaging face 32*b* of each engaging protrusion 32 of the dummy plug 30 is set at the engaging angle at which the engaging protrusion 32 can be prevented from being injured or the like at an engagement/disengagement or attachment/detachment time of the dummy plug 30, it is possible for the shaft portion 31 of the dummy plug 30 to be attached to/detached from the wire passing-through hole 19 of the bottom wall portion 15*c* of the outer housing 15 even though the engagement of the connector housing 11 and the dummy plug 30 is the inter-rigid body engagement and a flexible hook structure is not applied to the embodiment.

According to the above embodiment, the case where a wire is connected with pressure to a press-fitting terminal has been explained, but a terminal used in this embodiment is not limited to the press-fitting terminal. Namely, the embodiment can be applied to a case where a wire is connected with pressure-adhesion to a pressure-adhesion terminal.

The entire contents of Japanese Patent Application P10-298748 (filed Oct. 20, 1998) are incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. An engagement structure of a waterproof connector comprising:

a connector housing having a plurality of terminal accommodation chambers formed therein, the terminal accommodation chambers being chambers into which a terminal connected with a wire is to be inserted, the connector housing further having a plurality of rubber plug accommodation recesses formed therein, the rubber plug accommodation recesses being formed at positions opposed to the terminal accommodation chambers, the connector housing having one wall portion at an end opposed to the terminal accommodation chambers, and the one wall portion having wire insertion and passing-through holes configured to pass the wire therethrough, the rubber plug accommodation recesses being greater in cross section than the wire insertion and passing-through holes of the one wall portion;

rubber plugs respectively inserted forcibly into the plurality of rubber plug accommodation recesses such that each rubber plug substantially fills each accommodation recess and each accommodation recess is separated from other accommodation recesses by separation walls, the rubber plugs being respectively formed with wire insertion and passing-through holes configured to pass the wire therethrough; and a dummy plug having a shaft portion configured to be inserted into and to seal the wire insertion and passing-through hole of the rubber plug, the dummy plug further having a flange portion and at lease one engaging protrusion protruding from the shaft portion, the flange portion being greater in cross section than the wire insertion and passing-through hole of the one wall portion and being separated from the engaging protrusion such that a portion of the one wall portion around the wire insertion and passing-through hole of the one wall portion is sandwiched between the flange portion and the engaging protrusion when the shaft portion is inserted into the wire insertion and passing-through hole of the rubber plug and the wire insertion and passing-through hole of the one wall portion.

2. The engagement structure of claim 1, wherein the flange portion is circular in cross section.

3. The engagement structure of claim 1, wherein the flange portion is formed integrally with the shaft portion.

4. The engagement structure of claim 1, wherein a gap between the flange portion and the engaging protrusion is approximately equal to the thickness of the one wall portion.

5. The engagement structure of claim 1, wherein the engaging protrusion is generally triangular in shape.

6. The engagement structure of claim 1, wherein the dummy plug includes a plurality of engaging protrusions positioned at equal intervals around a peripheral face of the shaft portion.

7. The engagement structure of claim 6, wherein the engaging protrusions are formed integrally with the shaft portion.

8. The engagement structure of claim 1, wherein the engaging protrusion has an inclining face formed at a slant inclination angle and an engaging face formed at a predetermined engaging angle greater than the slant inclination angle.

9. The engagement structure of claim 8, wherein the engaging face faces the flange portion and the inclining face faces away from the flange portion.

* * * * *

UNITED STATES PATENT AND TRADEMARK OFFICE

CERTIFICATE OF CORRECTION

PATENT NO. : 6,390,848 B1 
DATED : May 21, 2002
INVENTOR(S) : Takao Murakami and Masaru Fukuda It is certified that error appears in the above-identified patent and that said Letters Patent is hereby corrected as shown below:

Column 8,
Line 56, "at lease" should read -- at least --.

Signed and Sealed this

Twentieth Day of August, 2002

*Attest:*

*Attesting Officer*

JAMES E. ROGAN
*Director of the United States Patent and Trademark Office*